United States Patent [19]

Derby

[11] Patent Number: 4,910,975

[45] Date of Patent: Mar. 27, 1990

[54] CONDIMENT COOLER

[76] Inventor: Donald A. Derby, 138 Cherrydell Rd., Baltimore, Md. 21228

[21] Appl. No.: 222,419

[22] Filed: Jul. 21, 1988

[51] Int. Cl.[4] ..... F25D 3/08

[52] U.S. Cl. ..... 62/372; 62/457.1; 62/463; 62/464

[58] Field of Search ..... 62/371, 372, 457, 459, 62/463, 464, 529, 457.1

[56] References Cited

U.S. PATENT DOCUMENTS

| | | | |
|---|---|---|---|
| 601,798 | 4/1898 | Slomka | 62/457 |
| 1,674,107 | 6/1928 | Graham | 62/463 X |
| 2,850,885 | 9/1958 | Mohr et al. | 62/372 |
| 4,655,052 | 4/1987 | Garcia | 62/464 X |

*Primary Examiner*—Lloyd L. King

[57] ABSTRACT

A device for cooling condiments, beverages and the like. The device includes an insulated chest which receives a cooling medium therein. The chest also carries a first stationary compartment and at least one second compartment. The chest has a base wall, side walls and an open top. The stationary compartment has a bottom wall, side walls, open top and a depth defined between the open top and the bottom wall thereof. Each of the second compartments has a respective bottom wall, side walls, open top and a depth defined between the open top and the bottom wall. The depth of the second compartment is less than the depth of the stationary compartment. Each of the compartments is positioned extending into the chest. Positioned thusly, the cooling medium directly contacts each of the bottom walls and at least two of the side walls of the stationary compartment, such that condiments therein are substantially surrounded by the cooling medium.

9 Claims, 5 Drawing Sheets

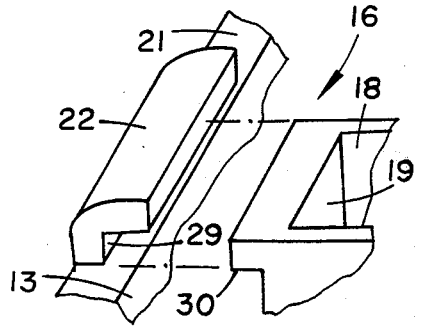
ig.5A
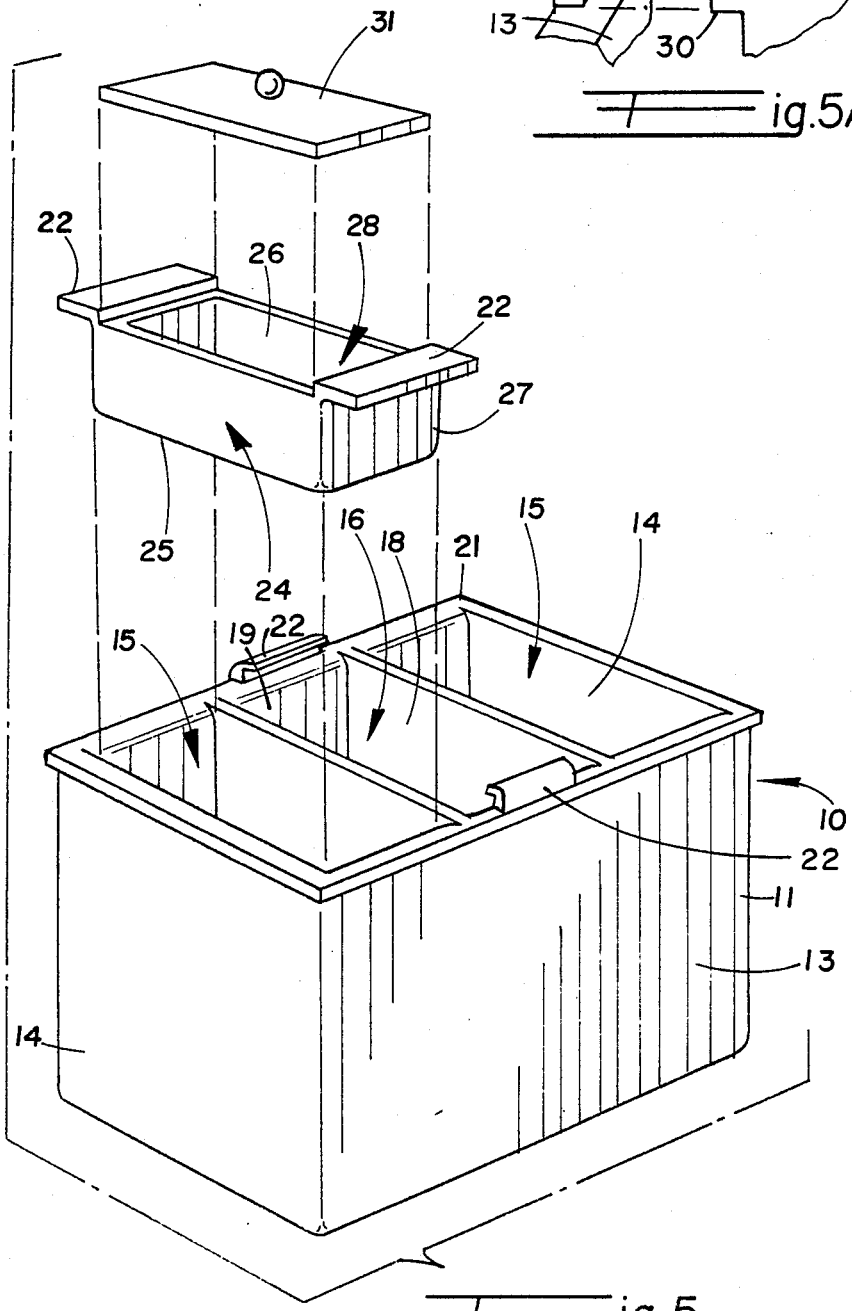
ig. 5

CONDIMENT COOLER

FIELD OF THE INVENTION

The present invention relates to coolers for condiments, beverages and the like and, more particularly, to a portable cooling device for housing and cooling condiments, beverages and the like.

BACKGROUND OF THE INVENTION

In food service establishments, such as restaurants and convenience stores where coffee and tea are served, condiments, such as cream and lemons, must be provided which need to be maintained in a cooled or chilled condition. Often several of these condiments, such as cream, are more susceptible to spoilage than others. Such condiments require the reliable and thorough cooling and chilling thereof.

In order to remedy the above-mentioned problems and to provide a suitable cooling device, the condiments are often made accessible by either: (1) simply placing the condiments on the cooling agent (such as ice); or (2) by placing the condiments in a container which loosely rests or sits on the cooling agent (such as ice). Unfortunately, both of these means of cooling or chilling run a high risk of contamination from the chilling or cooling agent; also, in the second case, while more effective than the first case, nonetheless looses its effectiveness as the ice melts and the container and its contents of condiments becomes unstable because of buoyancy. This can also lead to the condiments being contaminated by being splashed or spilled. Finally, neither of the above arrangements permits any particular condiment to be subjected to a more thorough chilling or cooling effect than the others.

Of interest to the present invention are the following portable cooler arrangements:

In the U.S. Letters Pat. No. 4,347,713 issued to Morrison, et al, there is disclosed a portable nd self-contained ice bucket having a compartmentalized portion for chilling condiments and the like. The bucket includes a base portion which is double-walled to provide an insulating effect; in which the cooling media, such as ice, is disposed. The bucket is open ended at the top and includes a complementary support of a compartmentalized condiment tray thereon in communication with the cooling media. This tray also serves as a cover or closure for the bucket.

While being extremely useful for its intended purpose, the device taught by Morrison, et al does not provide any means whatsoever, whereby any particular condiment may be subjected to a greater chilling or cooling effect than the others. The bottom wall of the compartment tray is level throughout its length and the cooling medium (ice) contacts only the bottom wall of the tray, thus, the device of Morrison et al is not able to substantially surround any of the condiments by the cooling media.

U.S. Pat. No. 2,543,524 issued to Oliveira discloses an isothermal food and liquid carrier to maintain food or beverages in a heated or cooled condition. The device includes a double-walled chest to provide insulation. The heating or cooling means is carried by the lid. Thermogenic receptacles are inserted directly into the chest for providing means for maintaining the temperature. The cooling means is electrically controlled and is not adaptable to use with ice or other liquid or potentially liquid cooling means.

While also being suitable for its purposes, the arrangement of Oliveira also has several drawbacks which make its use undesirable. In particular, there is no means by which any particular condiment in the chest can be more throughly chilled than others while being substantially surrounded by the cooling effect. There is only one compartment provided. Thus, each condiment disposed therein would cool similarly. If the chest were compartmentalized, then the cooling media would not substantially surround a particular condiment. Rather, the best that can be achieved is having cooling media on two sides of any compartment.

Finally, U.S. Pat. No. 4,286,440 issued to Taylor also discloses a portable cooler which is compartmentalized. As taught therein, only one surface of the coolant container is in direct communication with only one surface each compartment. Unfortunately, such an arrangement also does not either substantially surround any particular condiment or provide for a more through cooling of any particular condiment Accordingly, it can be seen that there remains a need to provide device for cooling or chilling condiments, beverages or the like which can provide a particular condiment with a more through chilling or cooling than the remaining condiments and which can substantially surround a particular condiment with the cooling medium.

SUMMARY OF THE INVENTION

A principal object of the present invention is to provide a device for cooling or chilling condiments, beverages and the like which can provide some condiments contained therein with a more thorough cooling effect than that provided to other condiments contained therein and which can substantially surround the condiment with a cooling medium.

It is another object of the present invention to provide a cooler, such as is described above, which is portable and can be conveniently located and accessible in areas where electrical refrigeration is not always available, such as service areas in restaurants, counters in convenience stores that feature "self-service" coffee and parties etc.

It is a further object of the present invention to provide a cooling device as described above which is not subject to buoyant movements resulting from, for example, the melting of the cooling medium.

In accordance with the teachings of the present invention, there is disclosed a cooler for condiments, beverages and the like which includes a chest for receiving a cooling medium therein. The chest has a base wall, side walls and an open top. A first (central) stationary compartment is carried by the chest for receiving the condiments, beverages or the like. In this manner, the condiments are not in direct contact with the cooling medium. The stationary compartment has a bottom wall, side walls and an open top. The compartment (or tray) is also positioned extending into the chest. The compartment extends into the chest so that the upper portion of the beverages and condiment are conveniently removable from the open top of the compartment. In this manner, the cooling medium directly contacts the said bottom wall and at least a portion of the side walls of the stationary compartment and the cooling medium substantially surrounding the condiments, beverages and the like disposed in the stationary compartment.

In a preferred embodiment, the side walls of the first stationary compartment includes a pair of substantially parallel side walls and a pair of substantially parallel end walls.

In another preferred embodiment, the chest has a bottom wall, a pair of substantially parallel side walls and a pair of substantially parallel end walls. Also, each of the end walls of the stationary compartment are carried by a respective wall of one of the pairs of parallel walls of the chest. Each of the side walls of the stationary compartment are spaced from a respective wall of the other of the pairs of parallel walls of the chest. In this fashion, the cooling medium directly contacts the said bottom and side walls of the stationary compartment substantially surrounding the condiments, beverages and the like disposed in the stationary compartment. Each of the end walls of the stationary compartment includes an outwardly extending tongue formed thereon. The side walls of the chest include a rim formed about the open top and a portion of the rim has a raised section with a slotted opening therein to form a groove for receiving the tongue of the stationary compartment. In this manner, the stationary compartment is removably and slidably carried by the chest, such that the stationary compartment may be slidably positioned on the chest so that the space between the side walls of the stationary compartment and the end walls of the chest may be varied.

The stationary compartment further has a depth defined between the open top and the bottom wall thereof. A pair of second compartments (or trays) are provided for receiving condiments, beverages or the like.

Each of the second compartments has a respective bottom wall, a pair of substantially parallel side walls, a pair of substantially parallel end walls and an open top. Each of said second compartments is adjacent to a respective side wall of the stationary compartment in the space between one of the side walls of the stationary compartment and the side wall of the chest. Each of said second compartments has a depth defined between the open top and the bottom wall thereof. The depth of the second compartment is less than the depth of the stationary compartment. In this fashion, the cooling medium directly contacts at least the bottom wall of the second compartment.

These and other objects and advantages of the present invention will become apparent from a reading of the description of the device contained herein, taken in conjunction with referenced to the annexed figures.

BRIEF DESCRIPTION OF THE DRAWINGS

FIG. 5 is an exploded perspective view of one embodiment of the device of the present invention wherein the first stationary compartment is integral with the chest.

FIG. 5A is an exploded perspective view showing the first stationary compartment slidably positioned on the chest.

DESCRIPTION OF THE PREFERRED EMBODIMENTS

Figure 1:
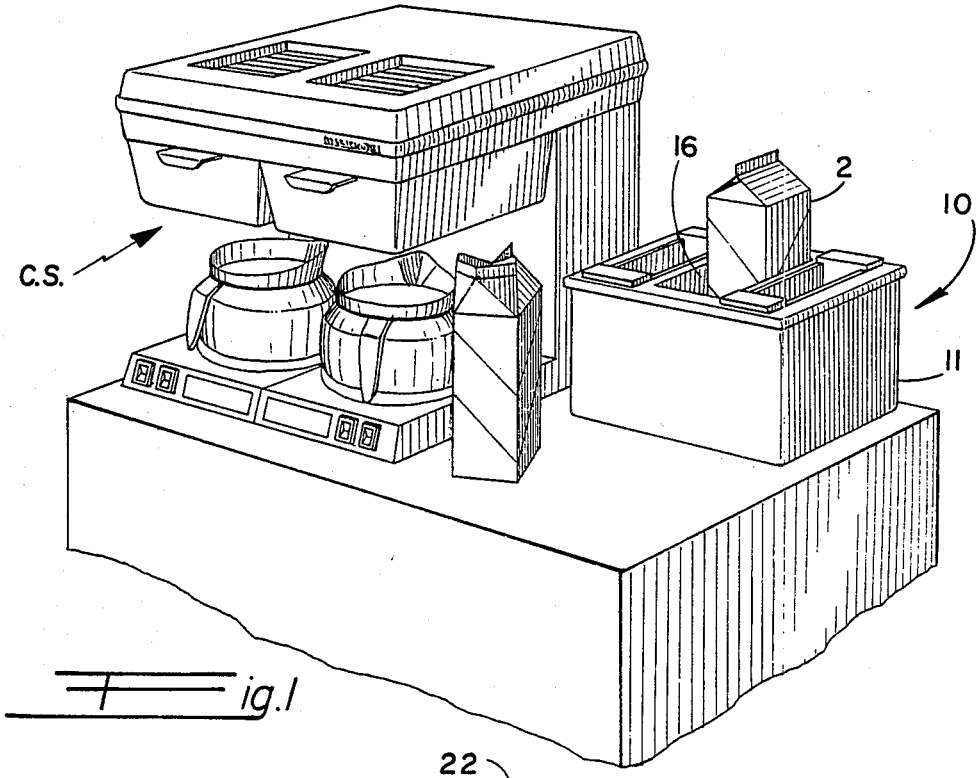
FIG. 1 is a perspective view of the device of the present invention during use thereof.
Figure 2:
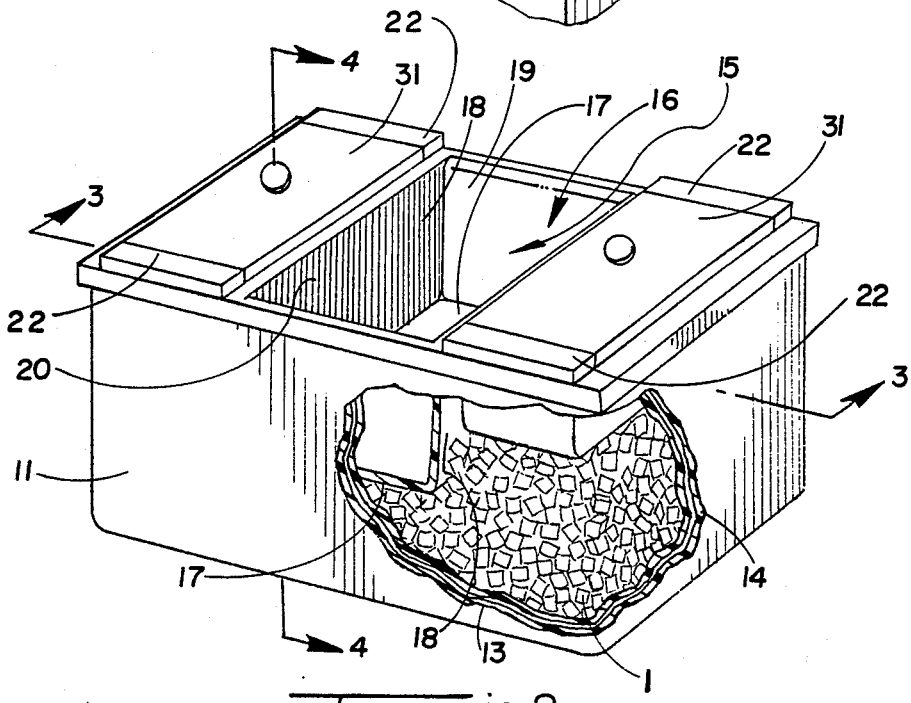
FIG. 2 is another perspective view of the device of the present invention to an enlarged scale and having a portion thereof broken away therefrom to reveal the double-walled chest and the positioning of stationary compartment, second compartments and the cooling medium in the chest.
Figure 3:
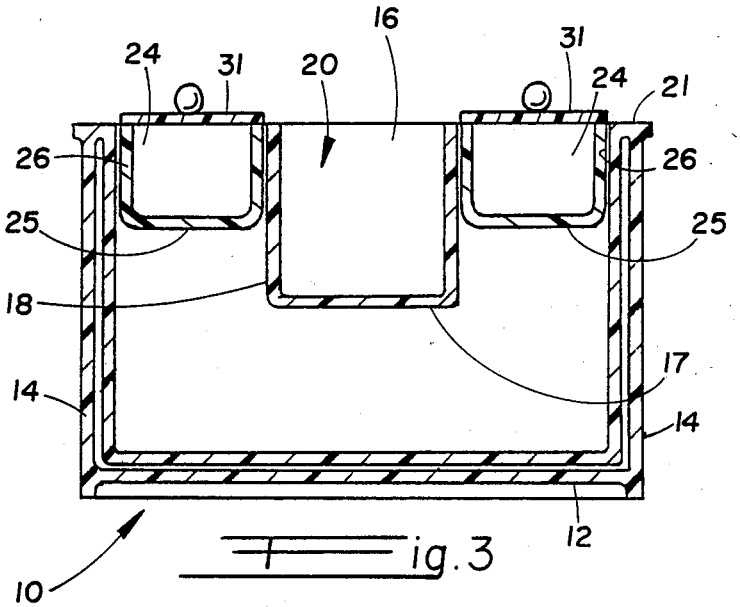
FIG. 3 is a section view taken along lines 3—3 of FIG. 2.
Figure 4:
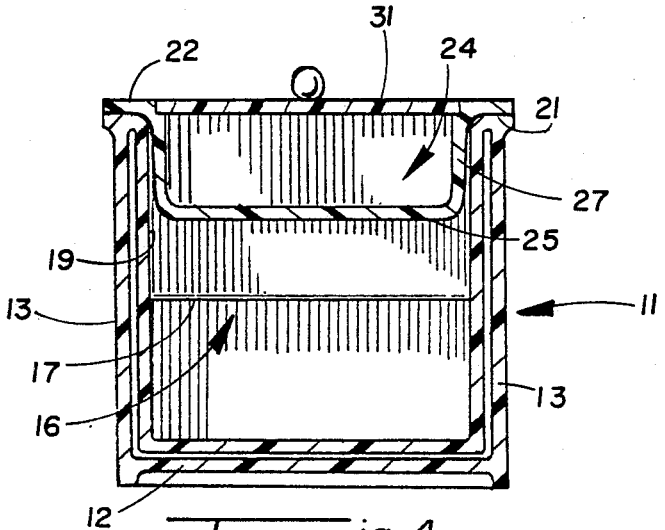
FIG. 4 is a section view taken along lines 4—4 of FIG. 2.
Figure 6:
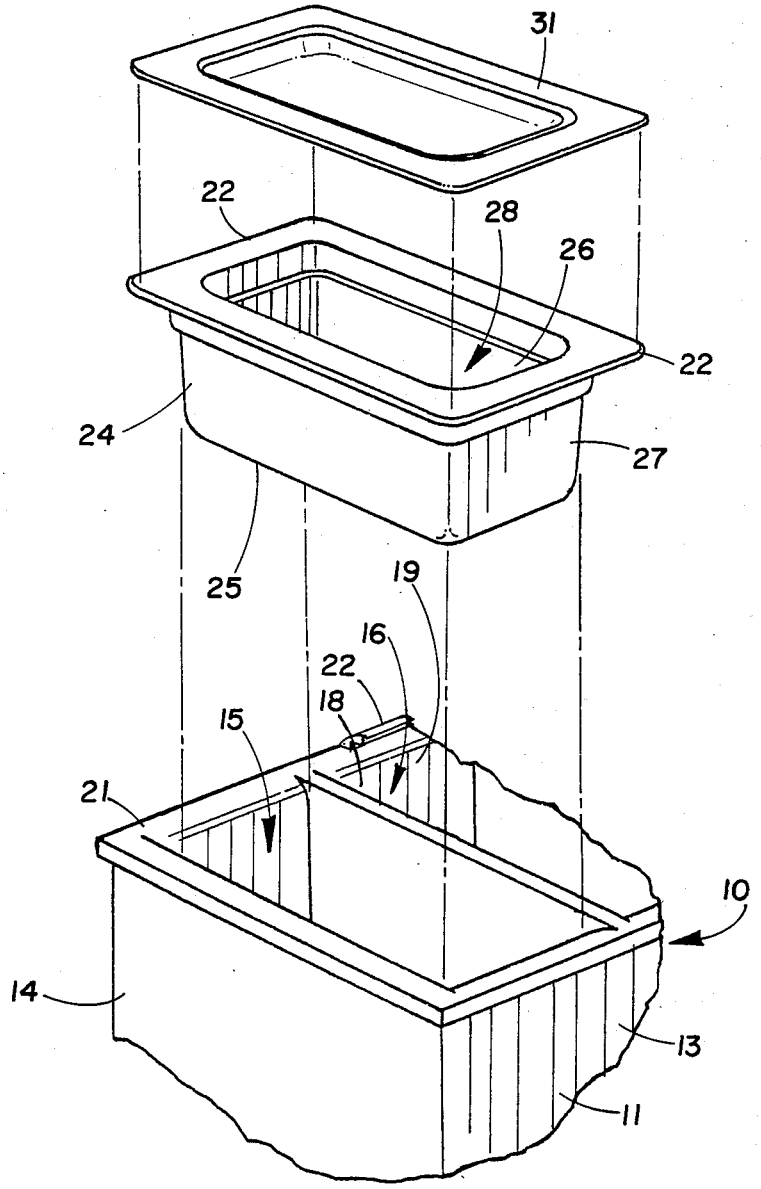
FIG. 6 is an exploded perspective view of another embodiment of the present invention wherein, if desired, a conventional tray may be utilized for the removable second compartment.

Referring now to the drawings, FIG. 1 illustrates a typical coffee server CS in a restaurant or convenience store showing the use of the present invention in a typical application.

Figure 7:
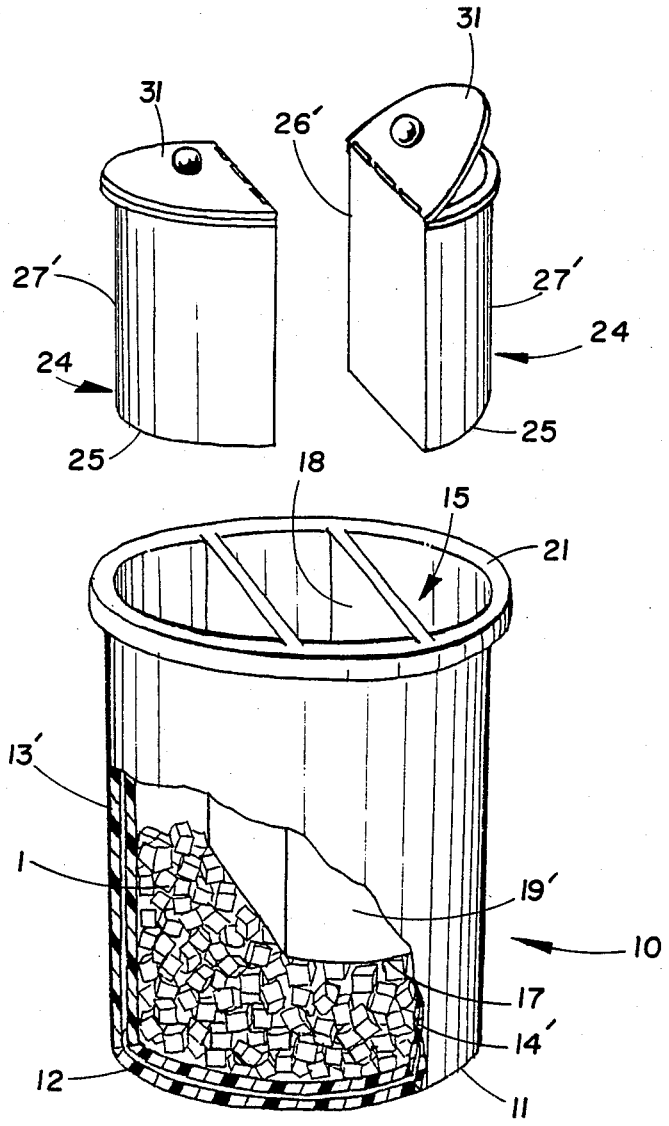
FIG. 7 is an exploded perspective view of another embodiment of the device of the present invention having a portion thereof broken away therefrom to reveal the double-walled chest and the positioning of one of the compartments and the cooling medium therein.

With reference to FIGS. 1–6, the cooler 10 includes a chest 11 for receiving a cooling medium, such as ice 1, therein. The chest 11 includes a base wall 12, side walls 13 and 14 and an open top 15. Preferably, and as illustrated herein, the side walls 13 and 14 include a pair of substantially parallel side walls 13 and a pair of substantially parallel end walls 14 (FIGS. 1–6). In another embodiment (as shown in FIG. 7), the side walls 13' and 14' are formed as a single contiguous cylindrical side wall.

It is further preferred that the base wall 12 and side walls 13 and 14 of the chest 11 be double-walled. This double-walled structure provides insulation and may be dead air space as shown in the drawing, or may be a foam or other type of insulation. This arrangement provides insulation for the cooler 10, such that the cooling medium 1 is maintained in its cooling or chilling state (which in the case of where ice is utilized as the cooling medium, refers to ice in its solid state) and further such that condensation (or sweat) on the external walls of the base wall 12 and side walls 13, and 14 is substantially reduced even in humid and normal conditions. The double-walled structure further increases thermal exchange between the cooling medium 1 and the condiments 2 carried in the compartments 16 (as shall be discussed later).

A first stationary compartment 16 is carried by the chest 11. Like the chest 11, the stationary compartment 16 includes a bottom wall 17, side walls 18 and 19 and an open top 20. Also, like the chest 11, it is preferred that the side walls 18 and 19 include a pair of parallel side walls 18 and a pair of substantially parallel end walls 19 (FIGS. 1–6). In another embodiment, (FIG. 7) the side walls are formed as a pair of substantially planar walls 18 and a curved wall 19' that extends between and joins the planar walls 18. The curved wall 19' has a curvature substantially corresponding to the curvature of the side wall of the chest 11.

Finally, a depth is defined between the open top 20 and the bottom wall 17 of the stationary compartment 16.

The first compartment 16 receives condiments, beverages and the like 2 therein, such that the side and bottom walls, 16, 17 and 18 of the compartment 16 are between the condiments 2 and the cooling medium 1. This insures that the condiments 2 are not in direct contact with the cooling medium 1. In this fashion, contamination of the condiments 2 by the cooling medium 1 is prevented.

The first compartment 16 is carried by opposite ends of the chest 11 extending over at least a portion of the open top 15 of the chest 11. Preferably, each of the end walls 19 of the stationary compartment 16 is carried by a respective wall of one of the parallel walls 13 or 14. It is most preferred that each of the end walls 19 be carried by a respective side wall 13. In this manner, the first compartment 16 extends into the chest 11, such that the cooling medium directly contacts the side walls 18 and the bottom wall 17 thereof, substantially surrounding any condiments, beverages and the like 2 which may be disposed therein.

Preferably, the first compartment 16 is 3/16 of an inch thick or thinner and is fabricated from thermally conductive material, such as stainless steel. However, it will be appreciated by those skilled in the art, that other materials may be substituted consonant with the teachings of the present invention and with the scope of the claims herein, and in accordance with the standards set forth by the National Sanitation Foundation. Thus, the walls are joined having an arcuate radius for ease of cleaning to meet health requirements.

By being carried by the chest 11, the first compartment 16 will remain stationary and will not be subject to buoyant movements, even when a cooling medium 1, such as ice, has melted. In a preferred embodiment, the compartment 16 is integral with the chest 11 (FIG. 5). In another embodiment, (as will be hereinafter discussed), the compartment 16 is removably carried by the chest 11 for selective removal therefrom.

When carried by the chest 11, the side walls 18 of the first compartment 16 are spaced from a respective wall 13 or 14 of the chest 11. Preferably, carried thusly, each side wall 18 is spaced from a respective end wall 14 of the chest 11. It is especially preferred, especially when the first compartment 16 is integral with the chest 11, that the side walls 18 of the first compartment 16 are spaced from a respective end wall 14 of the chest 11 in a substantially equal space relation thereto.

In another preferred embodiment, the relative sizes of the spaces between the walls 18 and 14 (or 13 may be adjusted by adjusting the relative positioning of the compartment 16 on the chest 11. This adjustability is provided by each of the end walls 19 of the stationary compartment 16 including an outwardly extending tongue 30 formed thereon (FIG. 5A). The side walls of the chest include a rim 21 formed about the open top. A portion of the rim 21 has a raised section 22 with a slotted opening 29 therein to form groove for receiving the tongue 30 of the stationary compartment 16. The stationary compartment 16 is removably and slidably carried by the chest 11, such that the stationary compartment 16 may be slidably positioned on the chest 11 so that the space between the side walls 18 of the stationary compartment 16 and the end walls 14 of the chest 11 may be varied. Further, it is possible to have the tongue formed on the rim of the chest to be received by the groove in the end wall of the stationary compartment. In the alternate embodiment with cylindrical walls (FIG. 7) a similar tongue and groove design permits slidable movement and removal of the stationary compartment, if desired.

At least one, and preferably a pair (two) of second compartments 24 is provided for receiving condiments, beverages and the like 2. Like the first compartment 16, each of the second compartments 24 is carried by, preferably opposite ends of, the chest 11. Each second compartment 14 has a respective bottom wall 25, side walls 26 and 27 and an open top 28. Preferably, the side walls include a pair of substantially parallel side walls 26, a pair of substantially parallel end walls 27 and a pair of lips 22 extending substantially perpendicularly, outwardly from the end walls 27 and supportable on the side wall 13 of the chest 11 (FIGS. 1–6). In another embodiment (FIG. 7), the side walls are formed as a pair of substantially planar side walls 26′ that intersect one another and a curved wall 27′ that extends between and joins the planar walls 26′. The curved wall 27′ has a curvature that corresponds substantially to the curvature of the side wall of the chest 11.

A depth is defined between the open top 28 and the bottom wall 25 of each of the second compartments 24. The depth of these second compartments 24 is less than the depth of the stationary compartment 16. Preferably the depth of the second compartments 24 is half of the depth of the stationary compartments 16.

Once again, the side walls 26 and 27 and bottom wall 25 of the second compartments 24 are between the condiments 2 and the cooling medium 1. This insures that the condiments 2 are not indirect contact with the cooling medium 1. In this fashion, contamination of the condiments 2 by the cooling medium 1 is prevented.

Each of the second compartments 24 is carried by the chest 11 positioned extending over at least a portion of the open top 15 of the chest 11, extending into the chest 11 in the spaces between the side walls 18 of the first compartment 16 and the chest 11. Positioned thusly, each of the second compartments 24 is adjacent to a respective side wall 18 of the stationary compartment 24 in the space. In this fashion, the cooling medium 1 directly contacts at least the bottom wall 25 of the second compartment 24.

Preferably, the second compartments 24 are 3/16 inch thick or thinner and are fabricated from thermally conductive material, such as stainless steel. However, it will be appreciated by those skilled in the art, that other materials may be substituted consonant with the teachings of the present invention and with the scope of the claims herein, and in accordance with the standards set forth by the National Sanitation Foundation. Thus, the walls are joined having an arcuate radius for ease of cleaning to meet health requirements.

If desired, each or some of the second compartments 24, may be integral with the chest. However, it is preferred that each of the second compartments 24 be selectively removable (see FIGS. 4, 5 and 6).

Finally, lids 31 may be provided for each of the compartments 16 and 24 and, if desired, the chest 11. Each of these lids 31 extends over and covers a respective open top 15, 20 or 28. It is preferred that the fit of the lids 31 on the respective compartments 16 and 24 (and chest 11) be tight enough to serve as a sealing fit. The lids 31 may also have an overlap, so as to preserve location and the fit of the compartments 16 and 24.

Obviously, many modifications may be made without departing from the basic spirit of the present invention. For example, it will be appreciated that the cooler can be made from a variety of materials available in the market to achieve the purposes described herein. Accordingly, it will be appreciated by those skilled in the art, that within the scope of the appended claims, the invention may be practiced other than has been specifically described herein.

What is claimed is:

1. A cooler for condiments, beverages and the like, in combination, comprising:

a chest for receiving a cooling medium therein, the chest having a bottom wall, a pair of substantially parallel side walls and a pair of substantially parallel end walls;

a first stationary compartment carried by the chest for receiving the condiments, beverages or the like such that said condiments are not in direct contact with the cooling medium, said stationary compartment having a bottom wall, a pair of parallel side walls, a pair of parallel end walls, and an open top, each of the end walls of the stationary compartment being carried extending into the chest by a respective side wall of the chest, each of the side walls of the stationary compartment being spaced from a respective end wall of the chest, such that the cooling medium directly contacts the said bottom and side walls of the stationary compartment substantially surrounding the condiments, beverages and the like disposed in the stationary compartment;

the stationary compartment further having a depth defined between the open top and the bottom wall thereof; and a pair of second compartments for receiving condiments, beverages or the like, each second compartment having a respective bottom wall, a pair of substantially parallel side walls, a pair of substantially parallel end walls and an open top, each of said second compartment being adjacent to a respective side wall of the stationary compartment in the space between one of the side walls of the stationary compartment and the side wall of the chest, each of said second compartments having a depth defined between the open top and the bottom wall thereof, the depth o the second compartment being less than the depth of the stationary compartment, such that the cooling medium directly contacts at least the bottom wall of the second compartment.

2. A cooler for condiments, beverages and the like, in combination, comprising:

a chest for receiving a cooling medium therein, the chest having a bottom wall, a pair of substantially parallel side walls and a pair of substantially parallel end walls;

a first stationary compartment carried by the chest, for receiving the condiments, beverages or the like, such that said condiments are not in direct contact with the cooling medium, said stationary compartment having a bottom wall, a pair of parallel side walls, a pair of parallel end walls, and an open top, each of the end walls of the stationary compartment being carried extending into the chest by a respective side wall of the chest, each of the side walls of the stationary compartment being spaced from a respective end wall of the chest, such that the cooling medium directly contacts the said bottom and side walls of the stationary compartment substantially surrounding the condiments, beverages and the like disposed in the stationary compartment, wherein each of the end walls of the stationary compartment includes an outwardly extending tongue formed thereon, further wherein the side walls of the chest include a rim formed about the open top thereof and wherein a portion of the rim has a raised section with a slotted opening therein to form a groove for receiving the tongue of the stationary compartment therein, whereby the stationary compartment is removably and slidably carried by the chest, such that the stationary compartment may be slidably positioned on the chest so that the space between the side walls of the stationary compartment and the end walls of the chest may be varied;

the stationary compartment further having a depth defined between the open top and the bottom wall thereof; and a pair of second compartments for receiving condiments, beverages or the like, each second compartment having a respective bottom wall, a pair of substantially parallel side walls, a pair of substantially parallel end walls and an open top, each of said second compartment being adjacent to a respective side wall of the stationary compartment in the space between one of the side walls of the stationary compartment and the side wall of the chest, each of said second compartments having a depth defined between the open top and the bottom wall thereof, the depth of the second compartment being less than the depth of the stationary compartment, such that the cooling medium directly contacts at least the bottom wall of the second compartment.

3. In a cooler for condiments, beverages and the like of the type having a chest for receiving a cooling medium therein, said chest including a base wall, side walls and an open top, the cooler further including a compartmentalized tray for receiving condiments beverages and the like therein said tray being received on and supported by the side walls of the chest over the open top thereof, such that the tray extends into the chest, the improvement thereupon comprising:

the tray including a stationary compartment having a bottom wall, side walls, an open top and a depth defined between the open top and the bottom wall, such that the cooling medium directly contacts the said bottom and side walls of the stationary compartment substantially surrounding the condiments, beverages and the like disposed therein;

the tray further including at least one second compartment each second compartment having a respective bottom wall, a pair of substantially parallel side walls, a pair of substantially parallel end walls and an open top, each of said second compartments being adjacent to a respective side wall of the stationary compartment in the space between one of the side walls of the stationary compartment and the side wall of the chest, each of said second compartments having a depth defined between the open top and the bottom wall thereof, the depth of the second compartment being less than the depth of the stationary compartment, such that the cooling medium directly contacts at least the bottom wall of the second compartment.

4. A cooler, especially intended to be used in cooperation with coffee or tea servers used in restaurants and convenience stores, comprising an insulated chest having means therein for receiving ice or a suitable cooling medium, the chest including at least a pair of parallel walls, the chest further including means therein forming a primary compartment intermediately of the parallel walls of the chest, the primary compartment being substantially closed within the chest and having an open top portion, such that the primary compartment is externally accessible of the chest, whereby at least one container of milk or cream may be supported within the primary compartment and may extend upwardly therefrom above the chest for convenient removal of the container from the chest, the chest further including at least one secondary compartment arranged between the primary compartment and the adjacent respective wall of the chest, whereby condiments may be stored in the secondary compartment if desired, and the primary compartment extending downwardly into the chest by a distance which is greater than the distance by which the secondary compartment extends downwardly into the chest, such that the ice or cooling medium substantially surrounds the primary compartment within which the container of milk or cream is supported.

5. The cooler of claim 4, wherein a lid covers the open top portion of the primary compartment.

6. The cooler of claim 4, wherein there are two secondary compartments, each of the secondary compartments being arranged between the primary compartment and each of the adjacent respective side walls of the chest.

7. The cooler of claim 4, wherein two second compartments are provided.

8. The cooler of claim 4, wherein the second compartment is removable.

9. The cooler of claim 4, further including the second compartment having a lid being received on the side walls and end walls of the second compartment extending over the open top thereof, thereby enclosing the second compartment.

* * * * *